United States Patent [19]

Yamato et al.

[11] Patent Number: 4,576,134

[45] Date of Patent: Mar. 18, 1986

[54] FUEL SUPPLY CONTROL METHOD FOR INTERNAL COMBUSTION ENGINES CAPABLE OF IMPROVING ACCELERABILITY OF THE ENGINE FROM AN IDLING REGION THEREOF

[75] Inventors: Akihiro Yamato; Yutaka Otobe, both of Shiki, Japan

[73] Assignee: Honda Giken Kogyo K.K., Tokyo, Japan

[21] Appl. No.: 618,532

[22] Filed: Jun. 8, 1984

[30] Foreign Application Priority Data

Jun. 21, 1983 [JP] Japan ..... 58-111664

[51] Int. Cl.[4] ..... F02D 41/08

[52] U.S. Cl. ..... 123/480; 123/274; 123/486; 123/491

[58] Field of Search ..... 123/480, 486, 478, 491, 123/274

[56] References Cited

U.S. PATENT DOCUMENTS 4,201,159 5/1980 Kawai et al. ..... 123/480
4,306,529 12/1981 Chiesa et al. ..... 123/486
4,313,412 2/1982 Hosaka et al. ..... 123/480
4,418,674 12/1983 Hasegawa et al. ..... 123/274

*Primary Examiner*—Andrew M. Dolinar
*Attorney, Agent, or Firm*—Arthur L. Lessler

[57] ABSTRACT

A fuel supply control method for an internal combustion engine having exhaust gas purifying means arranged in its exhaust passage, in which a plurality of predetermined basic fuel quantity values corresponding, respectively, to different predetermined values of at least one operating parameter of the engine are selectively read out in response to detected values of the same parameter to thereby determine fuel supply quantities appropriate to operating conditions of the engine. Among the above basic fuel quantity values, those which correspond to ones of the above predetermined parameter values that are to be assumed when the engine is operating in an idling region are set at such predetermined values as to obtain an air-fuel mixture having a predetermined air-fuel ratio at which the exhaust gas purifying means can exhibit the maximum conversion efficiency. When the engine is operating in the idling region, each of the above corresponding basic fuel quantity values which is read out is decreased by a predetermined correction amount.

9 Claims, 7 Drawing Figures

9
CYL SENSOR
21
Ne SENSOR
20
θTH SENSOR
8
PBA SENSOR
14
TA SENSOR
15
O2 SENSOR
18
TW SENSOR
19
WAVEFORM SHAPER CIRCUIT
910
WAVEFORM SHAPER CIRCUIT
901
CPU
902
ROM
911
RAM
912
DRIVING CIRCUIT
913
Me COUNTER
903
904
A/D CONVERTER
907
MULTI-PLEXER
906
LEVEL SHIFTER UNIT
905
#1 MAIN INJECTOR
11
#2 MAIN INJECTOR
11
#3 MAIN INJECTOR
11
#4 MAIN INJECTOR
11
SUB INJECTOR
12

| Ne \ PBA | P1 | P2 | ..... | Pi | ..... | P15 |
|---|---|---|---|---|---|---|
| N1 | T1,1 | T2,1 | | Ti,1 | | T15,1 |
| ⋮ | | | | | | |
| Nj | T1,j | T2,j | | Ti,j | | T15,j |
| ⋮ | | | | | | |
| N15 | T1,15 | T2,15 | | Ti,15 | | T15,15 |

FUEL SUPPLY CONTROL METHOD FOR INTERNAL COMBUSTION ENGINES CAPABLE OF IMPROVING ACCELERABILITY OF THE ENGINE FROM AN IDLING REGION THEREOF

BACKGROUND OF THE INVENTION

This invention relates to a fuel supply control method for internal combustion engines, and more particularly to a method of this kind which is adapted to improve the accelerability of the engine from an idling region thereof.

Fuel supply control methods conventionally employed for controlling the fuel supply to internal combustion engines are generally intended to improve operating characteristics of the engine such as accelerability thereof. Among such fuel supply control methods has been proposed e.g. by Japanese Provisional Patent Publication No. 49-119080 a method which comprises providing a map in which are set a plurality of basic fuel quantity values corresponding, respectively, to a plurality of predetermined combinations of two operating parameters of the engine (e.g. engine rpm and intake pipe absolute pressure), reading from the map a basic fuel quantity value which corresponds to detected values of the two operating parameters, and correcting the read basic fuel quantity value by the use of a correction value corresponding to an operating condition in which the engine is operating, to thereby set a fuel supply quantity optimal to the actual operating condition of the engine.

In such type fuel control method using a basic fuel quantity value map, in order to improve the fuel consumption during idling operation of the engine, some of the basic fuel quantity values of the map that correspond to an idling region of the engine are set at relatively smaller values so as to set the air-fuel ratio of an air-fuel mixture to be supplied to the engine at a leaner value than a theoretical mixture ratio.

However, according to such conventional setting of basic fuel quantity values in the map, if the engine is accelerated with the opening action of the throttle valve when the engine is operating in such idling region, fuel supply control is still continued by the use of basic fuel quantity values set to supply a lean mixture to the engine while the engine is operating in the idling region, even when the engine requires the supply of an increased quantity of fuel required for such acceleration. As a consequence, a rich mixture is not supplied to the engine until after the engine has left the idling region, resulting in deterioration of the accelerability of the engine. The above map setting of basic fuel quantity values is also disadvantageous when applied to a control method of starting to control the air-fuel ratio of the mixture to a predetermined or stoichiometric value upon opening of the throttle valve, in that it is difficult to promptly control the air-fuel ratio to the above predetermined or stoichiometric value upon a transition from the idling region to the feedback control region. Furthermore, the above map setting has difficulties in applying same to a control method of varying the fuel supply quantity to the engine in response to on-off actions of auxiliary equipments of the engine as well, in that to obtain a predetermined increased fuel supply quantity corresponding to an on state of an auxiliary equipment, two different correction values as aforementioned have to be provided for increasing the basic fuel quantity value between the idling region and the feedback control region, inviting complexity of the fuel supply control.

The same problems as above are also encountered in the fuel supply control of internal combustion engines equipped with auxiliary chambers.

SUMMARY OF THE INVENTION

It is an object of the invention to provide a fuel supply control method for an internal combustion engine, which is capable of improving the accelerability of the engine from an idling region thereof, as well as enhancing the control responsiveness in transition of the engine operation from the idling region to a feedback control region.

It is another object of the invention to provide a fuel supply control method for an internal combustion engine, which is capable of controlling in a simplified manner the quantity of fuel being supplied to the engine in response to on-off states of auxiliary equipments provided in the engine.

It is still another object of the invention to provide a fuel supply control method for an internal combustion engine equipped with auxiliary chambers, which is capable of controlling the air-fuel ratio of mixtures to be supplied to main chambers and auxiliary chambers of the engine to respective proper values during idling of the engine, thereby avoiding excessive leaning of the mixture being supplied to the auxiliary chambers which would be caused by leaning of the mixture being supplied to the main chambers during idling of the engine.

According to the present invention, there is provided a fuel supply control method for an internal combustion engine having exhaust gas purifying means arranged in its exhaust passage, which is adapted to store a plurality of predetermined basic fuel quantity values which correspond, respectively, to a plurality of predetermined values of at least one operating parameter of the engine, detect the value of the at least one operating parameter, read out one of the above predetermined basic fuel quantity values which corresponds to the detected value of the at least one operating parameter, determine from the read one basic fuel quantity value a quantity of fuel appropriate to an operating condition in which the engine is operating, and supply the determined quantity of fuel to the engine.

The method according to the invention is characterized by the following steps: (a) setting at least part of the basic fuel quantity values which correspond to ones of the above predetermined values of the at least one operating parameter that are to be assumed when the engine is operating in an idling region, at such predetermined values as to obtain an air-fuel mixture having a predetermined air-fuel ratio at which the exhaust gas purifying means can exhibit an optimum conversion efficiency thereof; (b) determining whether or not the engine is operating in the idling region; and (c) decreasing by a predetermined correction value each of the at least part of the basic fuel quantity values set to the predetermined values which is read out, when it is determined that the engine is operating in the idling region.

The above and other objects, features, and advantages of the invention will be more apparent from the ensuing detailed description taken in conjunction with the accompanying drawings.

DETAILED DESCRIPTION

The method of the invention will now be described in detail with reference to the drawings showing an embodiment thereof.

Figure 1:
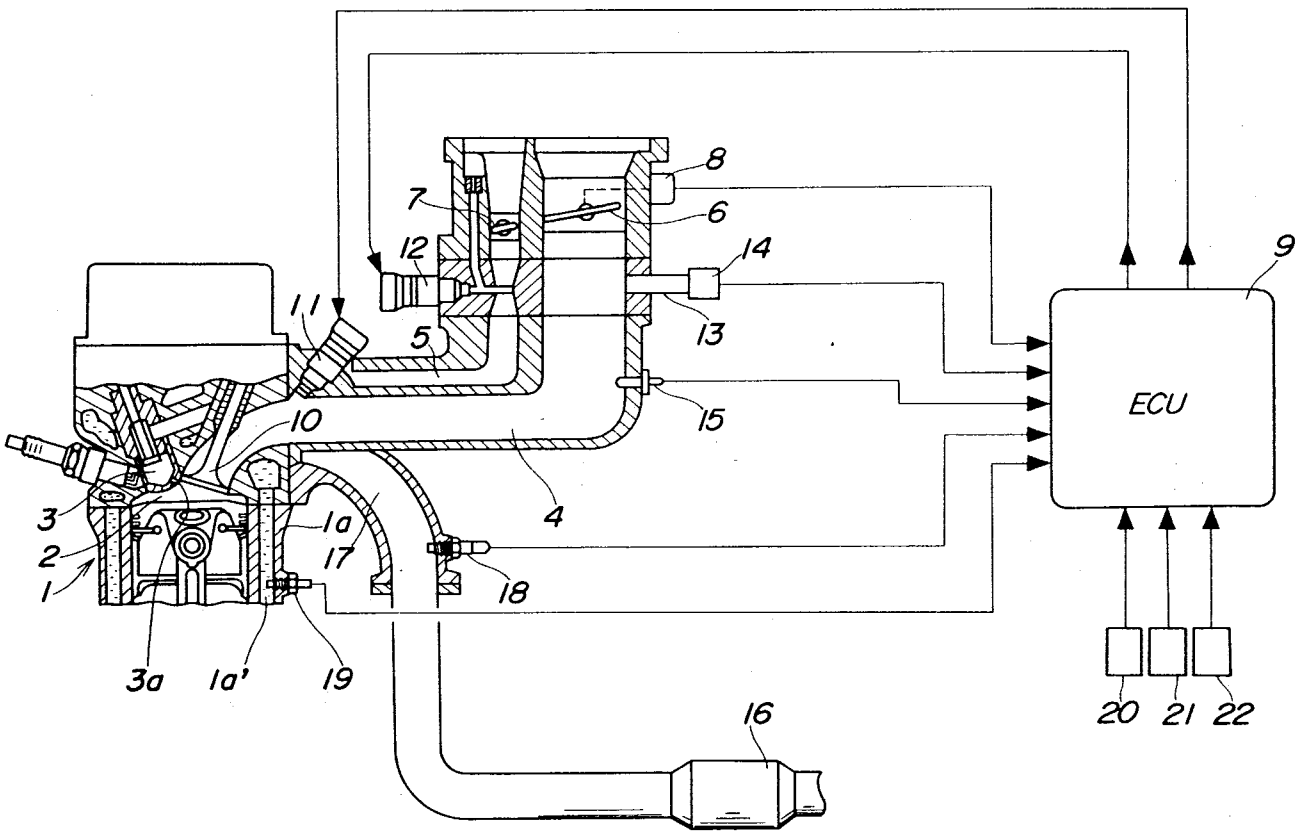
FIG. 1 is a schematic view illustrating the whole arrangement of a fuel injection control system to which is applied the fuel supply control method according to the present invention.

Referring first to FIG. 1, an electronic fuel injection control system is illustrated, by way of example, to which is applicable the method of the invention. Reference numeral 1 designates an internal combustion engine which may be a four cylinder type (only one of the four cylinders is shown), each cylinder of which has a main chamber (main combustion chamber) 2, an auxiliary chamber (sub combustion chamber) 3 communicating with the main chamber 2 through a torch bore 3*a*. A main throttle valve 6 is arranged in a main intake pipe 4 connected to all the main chambers 2, at an upstream location thereof, while a sub throttle valve 7 is arranged in a sub intake pipe 5 connected to all the auxiliary chambers 3, at an upstream location thereof for operation in unison with the main throttle valve 6. A throttle valve opening ($\theta$th) sensor 8 is mounted on the main intake pipe 4 and operatively connected to the main throttle valve 6 for detecting the valve opening of the main throttle valve 6 in the form of an electrical signal.

Main injectors 11 forming part of a fuel injection device are provided, respectively, for the cylinders of the engine, each of which is arranged in the main intake pipe 4 at a location slightly upstream of the intake valve 10 of each cylinder, while a single sub injector 12 is arranged in the sub intake pipe 5 at a location slightly downstream of the sub throttle valve 7 for supplying fuel to all the cylinders. These injectors 11, 12 are connected to a fuel pump and a fuel tank, neither of which is shown.

An intake pipe absolute pressure (PBA) sensor 14 communicates with the interior of the main intake pipe 4 through a pipe 13, at a location downstream of the main throttle valve 6. An intake air temperature (TA) sensor 15 is mounted in the main intake pipe 4 at a location slightly downstream of the sensor 14. An exhaust pipe 17 extends from the main combustion chambers 2 within the cylinders, in which is inserted an $O_2$ sensor 18 for sensing oxygen concentration in the exhaust gases, and across which is arranged a three-way catalyst 16. An engine cooling water temperature (TW) sensor 19 is inserted into a cooling water passage 1*a'* formed within a cylinder block 1*a* of the engine 1. The above sensors 8, 14, 15, 18 and 19 and the injectors 11, 12 are all electrically connected to an electronic control unit (hereinafter called "the ECU") 9.

Also electrically connected to the ECU 9 are a rotational angle position (Ne) sensor 20 arranged on a crankshaft, not shown, of the engine for generating a TDC signal indicative of predetermined crank angle positions of the engine, e.g. at 60 degrees before top-dead-center positions, a cylinder-discriminating (CYL) sensor 21 arranged on the crankshaft for generating a signal indicative of a predetermined crank angle position of a particular one of the cylinders, e.g. a first cylinder, and a vehicle speed switch 22 adapted to provide an on-state signal when the speed of an associated vehicle is above a predetermined speed (e.g. 45 km/h), and an off-state when the vehicle speed is below the predetermined speed.

Figure 2:
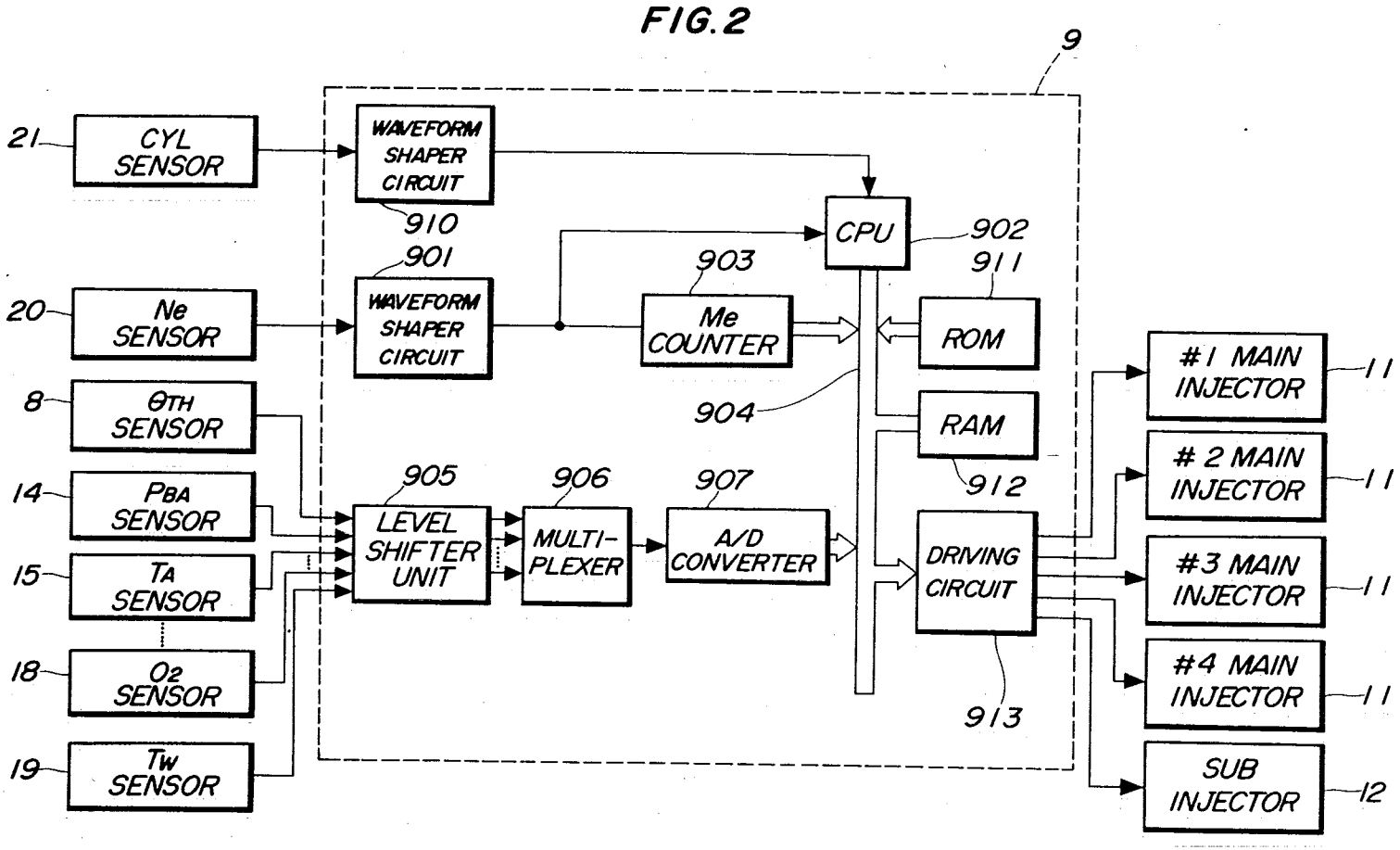
FIG. 2 is a block diagram illustrating the interior construction of an electronic control unit in FIG. 1.

FIG. 2 shows an example of the interior construction of the ECU 9 in FIG. 1. A TDC signal from the engine rotational angle position sensor 20 is supplied to a waveform shaper circuit 901 to have its pulses subjected to waveform shaping, and the shaped pulses are supplied to a central processing unit (hereinafter called "the CPU") 902, as well as to an Me counter 903. The Me counter 903 counts the interval of time between a preceding pulse of the TDC signal from the engine rotational angle position sensor 20 and a present pulse of same, to obtain a counted value Me which is proportional to the reciprocal of the engine rpm Ne, and supplies the counted value Me to the CPU 902 via a data bus 904.

Output signals indicative of various operating parameters of the engine, e.g. from the throttle valve opening sensor 8, the intake pipe absolute sensor 14, the intake air temperature sensor 15, the $O_2$ sensor 18, the engine cooling water temperature sensor 19, etc., all appearing in FIG. 1, are applied to a level shifter unit 905 to have their voltage levels shifted to a predetermined value, and the shifted sensor output voltages are successively applied to an A/D converter 907 by means of a multiplexer 906, where they are successively converted into respective corresponding digital signals. The digital signals thus obtained are successively supplied to the CPU 902 through the data bus 904. Further, an output signal from the cylinder-discriminating signal 21 indicative of the particular crank angle position with respect to the first cylinder is applied to a waveform shaper circuit 910 to have its waveform shaped, and the resulting shaped pulses are supplied to the CPU 902.

Also connected to the CPU 902 through the data bus are a read-only memory (hereinafter called "the ROM") 911, a random access memory (hereinafter called "the RAM"), and a driving circuit 913. The RAM 912 temporarily stores various resulting values obtained by calculations executed within the CPU 902, while the ROM 911 stores a control program to be executed by the CPU 902, etc.

Figures 3, 4:
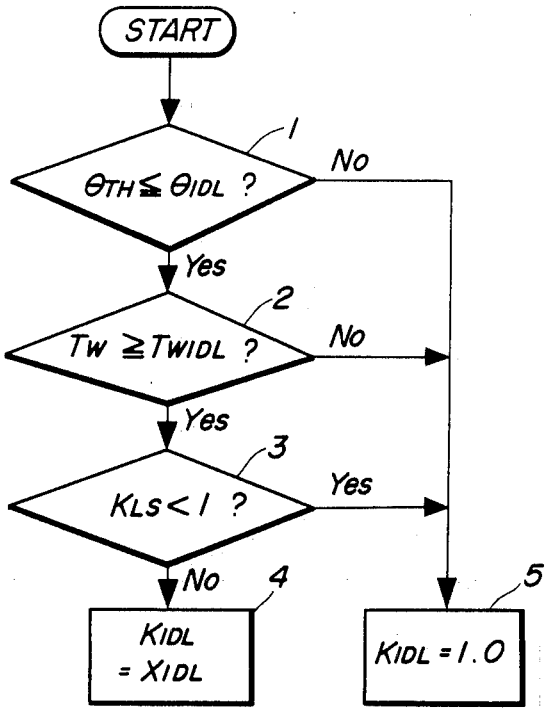
FIG. 3 is a view showing a map of basic fuel injection period for injectors according to the method of the invention.
FIG. 4 is a flowchart of a subroutine for determining the value of a mixture-leaning coefficient KIDL applicable at idle of the engine, according to the method of the invention.

The CPU 902 operates in accordance with the control program stored in the ROM 911 to determine operating conditions of the engine such as the loaded condition of same in response to the aforementioned various engine operating parameter signals, and calculate the valve opening period TOUTM for the main injectors 11 provided for respective engine cylinders and the valve opening period TOUTS for the sub injector 12 for common use with all the engine cylinders, by the use of the following equations (1) and (2):

$$TOUTM = TiM \times KIDL \times KLS \times K1 + K2 \ldots \quad (1)$$

$$TOUTS = TiS \times KSR + K3 \ldots \quad (2)$$

where TiM and TiS represent basic fuel injection period values for the main injectors 11 and the sub injector 12, respectively. These basic fuel injection period values are read from respective maps such as one shown in FIG. 3 by way of example. In the example of FIG. 3, a plurality of predetermined basic fuel injection period values are provided which correspond, respectively, to intersecting points or lattice points Mi,j ( i,j=1, 2 . . . , 15) of predetermined values P1, P2 . . . , P15 of intake pipe absolute pressure PBA, and predetermined values N1, N2 . . . , N15 of engine rotational speed (rpm) Ne. The lattice points Mi,j (i,j=1−3) in at least a region in the basic fuel injection period map within the ROM 911, which corresponds to an idling region of the engine (the hatched portion in FIG. 5), or preferably all the lattice points Mi,j (=1−15) throughout the whole region of the map corresponding to the whole operating regions of the engine, are provided with basic fuel injection period values as to make the air-fuel ratio of the mixture equal to a predetermined or theoretical mixture ratio value (14.7).

These basic fuel injection period values TiM, TiS, stored at respective lattice points of the respective maps within the ROM 911, are selectively read from the maps in response to detected values of the intake pipe absolute pressure PBA and the engine rotational speed (rpm) Ne.

In the aforementioned equation (1), KIDL represents a mixture-leaning coefficient applicable when the engine is operating in the idling region, and KLS a mixture-leaning coefficient applicable when the engine is operating in a predetermined low load region. In the aforementioned equation (2), KSR is a mixture-enriching coefficient for enriching a mixture being supplied to the sub injector 12, as hereinafter described in detail.

In the equations (1), (2), K1 represents a correction coefficient, and K2 and K3 correction variables, respectively. These correction coefficient and correction variables are calculated in response to values of the engine operating parameter signals from the aforementioned various sensors, and set to such values as to optimize operating characteristics of the engine such as emission characteristics, fuel consumption, and accelerability.

FIG. 4 is a flowchart of a subroutine for determining the value of the mixture-leaning coefficient KIDL applicable at idling of the engine according to the method of the invention. First, it is determined at the step 1 whether or not a detected value of the valve opening θth of the main throttle valve 6 is equal to or smaller than a predetermined value θIDL, e.g. a valve opening corresponding to a substantially fully closed position of the throttle valve. If the answer is yes, it is then determined at the step 2 whether or not a detected value of the engine cooling water temperature TW is higher than a predetermined value TWIDL (e.g. 61° C.). If the answer to the question of the step 2 is affirmative, a determination is made as to whether or not the mixture-leaning coefficient KLS is smaller than 1, that is, whether or not leaning of the mixture is being effected while the engine is operating in a predetermined low load region as hereinafter referred to, at the step 3. If the answer is no, the mixture-leaning coefficient KIDL is set to a predetermined value XIDL at the step 4, thereby effecting leaning of the mixture to be supplied to the main chambers 2 of the engine at idling.

Figure 5:
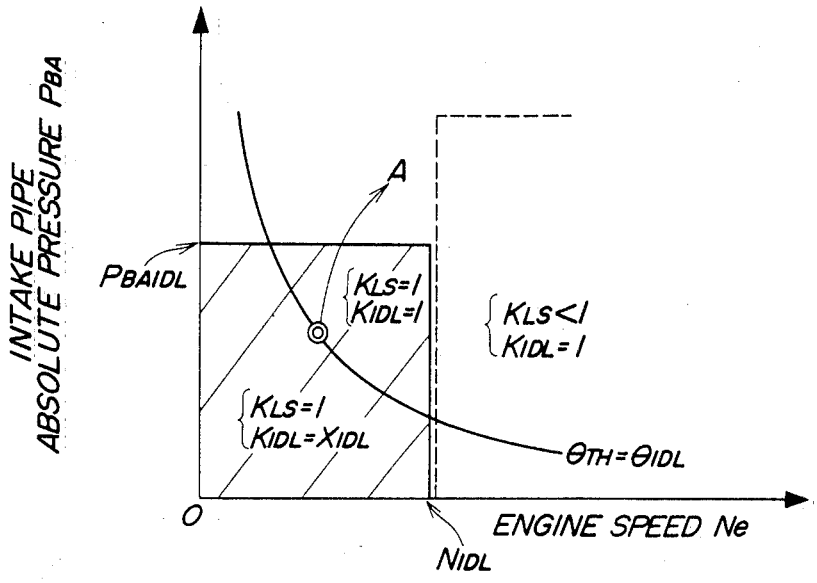
FIG. 5 is a graph showing the idling region of the engine to which is applied the method of the invention.

By virtue of the above fuel supply control, the accelerability of an associated vehicle from its standing position can be enhanced in accelerating from the idling region (PBA<PBAIDL and Ne<NIDL) which is hatched in FIG. 5, as compared with the conventional fuel supply control method wherein the fuel supply is effected irrespective of the valve opening of the throttle valve, by the use of basic fuel quantity values set to smaller values in an idling region than values corresponding to a theoretical mixture ratio so as to lean the mixture in the same idling region. More specifically, let it be assumed that the vehicle is started to run from an idling point indicated by the double circle in FIG. 5 along the line indicated by the arrow A. According to the conventional method, the leaning of the mixture is continued until after the engine has left the idling region even if the throttle valve opening θth increases above the predetermined value θIDL whereby the engine has shifted into an accelerating state. On the other hand, according to the method of the present invention, the leaning of the mixture is interrupted immediately when the throttle valve opening θth increases above the predetermined value θIDL, even though the engine condition is still then in the idling region (the steps 1 and 5 in FIG. 4), thereby enabling to promptly respond to accelerating requirement of the engine. The fuel supply control based upon detection of the throttle valve opening value according to the invention is advantageous over the fuel supply control based upon detection of the intake pipe absolute pressure PBA in achieving enhanced control responsiveness to accelerating condition of the engine.

Further, the system of FIG. 1 is adapted to determine whether or not the engine is operating in the aforementioned low load region of the engine in response to operating parameters of the engine, e.g. the intake pipe absolute pressure, the rotational speed of the engine, and on-off states of the vehicle switch 22, and to set the value of the mixture-leaning coefficient KLS to a value smaller than 1 to lean the mixture for curtailment of the fuel consumption, if the engine is determined to be operating in the low load region. According to the method of the invention applied to the system of FIG. 1 thus adapted, if the answer to the question of the step 3 in FIG. 4 is affirmative (Yes) or the coefficient KLS has a value other than 1, leaning of the mixture is prohibited even if the answers to the questions of the steps 1 and 2 in the same figure are affirmative, thus avoiding leaning of the mixture to an excessive degree.

Further, if the answer to the question of the step 2 is negative (No), the value of the mixture-leaning coefficient KIDL is set to 1, thereby prohibiting leaning of the mixture to an excessive degree when the engine is in a cold state wherein the engine cooling water temperature TW is lower than the predetermined value TWIDL, for instance.

Figure 6:
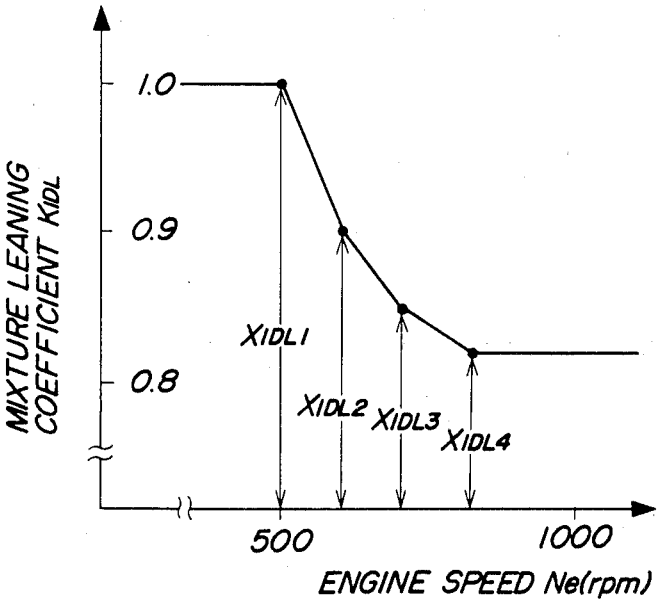
FIG. 6 is a graph showing an example of setting of the value of the mixture-leaning coefficient KIDL.

The predetermined value XIDL to which is set the coefficient KIDL in the step 4 in FIG. 4 is set as shown in FIG. 6, that is, it is set so as to vary from a value XIDL1 (e.g. 1.0) to a value XIDL4 (e.g. 0.82) as the engine rotational speed Ne increases. This value XIDL is also stored in the ROM 911 in FIG. 2 such that its value XIDLi (i=1−4) is read under command from the CPU 902 in response to detected rotational speed Ne, or if required, it is calculated by an interpolation method from two read values XIDLi and XIDLi+1.

According to the method of the invention, when the engine is operating in the idling region, the fuel supply control is effected so as to set the air-fuel ratio to a relatively large value, e.g. a value larger than the theoretical mixture ratio. For instance, in an internal combustion engine equipped with the three-way catalyst 16, a predetermined value larger than the theoretical mixture ratio, for instance, 16.5 is set as a desired value. The degree of leaning of the mixture to achieve this desired air-fuel ratio value is reduced as the engine rotational speed Ne decreases so as to ensure stable rotation of the engine. As shown in FIG. 6, below 500 rpm of the engine rotational speed Ne, the leaning of the mixture is prohibited by setting the value of the mixture-leaning coefficient KIDL to 1.0, so as to avoid engine stall in such low speed region.

Figure 7:
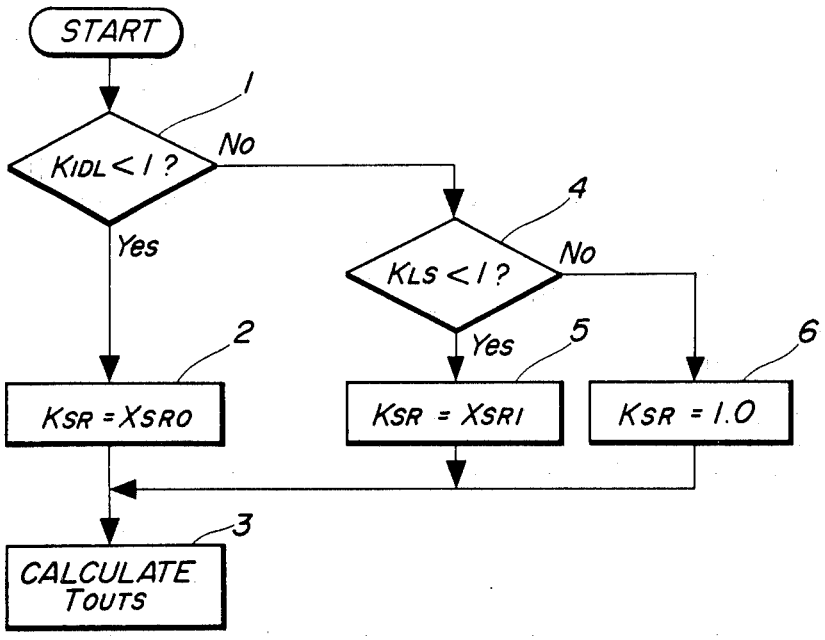
FIG. 7 is a flowchart of a subroutine for determining the value of a mixture-enriching coefficient KSR employed by the method of the invention for enriching a mixture being supplied to auxiliary chambers of the engine.

FIG. 7 shows a subroutine for determining the value of the coefficient KSR for enriching a mixture to be supplied to the auxiliary chambers 3 in FIG. 1. It is first determined at the step 1 whether or not the mixture-leaning coefficient KIDL applied at idling of the engine is smaller than 1. If the answer is affirmative, the value of the coefficient KSR is set to a predetermined value XSR0 (e.g. 1.10), at the step 2, followed by calculating the valve opening period TOUTS for the sub injector 12 by the use of the aforementioned equation (2), at the step 3. That is, according to the method of the invention which is applied to an internal combustion engine equipped with auxiliary chambers as in FIG. 1, when the engine is operating in an idling region, the air-fuel ratio of the mixture to be supplied to the main chambers 2 is set to a value larger than the aforementioned predetermined value (e.g. 16.5) by applying as the mixture-leaning coefficient KIDL the coefficient XIDL set to a value slightly smaller than that in the example of FIG. 6, while simultaneously the air-fuel ratio of the mixture to be supplied to the auxiliary chambers 3 is set to a value smaller than the same predetermined value by applying the mixture-enriching coefficient KSR to enrich the same mixture, so that the total air-fuel ratio of the mixture supplied to the main chambers 2 and the auxiliary chambers 3 is equal to the above predetermined value (16.5). By so controlling the air-fuel ratios of the mixtures supplied to the main chambers 2 and the auxiliary chambers 3, excessive leaning of the mixture supplied into the auxiliary chambers 3 can be prevented which would be caused by leaning of the mixture supplied into the main chambers 2, to thereby prevent an unfavorable phenomenon resulting from such excessive leaning, such as misfire in the auxiliary chambers.

Referring again to FIG. 7, if the answer to the question at the step 1 is negative, it is determined at the step 4 whether or not the mixture-leaning coefficient KLS has a value smaller than 1.0. If the answer to this is affirmative, that is, if it is determined that leaning of the mixture being supplied to the main chambers 2 is now effected by the use of the coefficient KLS, the program proceeds to the step 5 to set the value of the mixture-enriching coefficient KSR to a predetermined value XSR1 (e.g. 1.05) smaller than the aforementioned predetermined value XSR0, followed by calculating the valve opening period TOUTS using the same value XSR1, at the step 3. This is to maintain the air-fuel ratio of the mixture supplied to the sub chambers at a required moderate value also while the mixture supplied to the main chambers 2 is leaned, when the engine is operating in the low load region.

If the answer to the question at the step 4 is negative, that is, if it is determined that the engine is not operating in either the idling region or the low load region, the value of the mixture-enriching coefficient KSR is set to a value of 1.0, at the step 6, followed by calculation of the valve opening period TOUTS using the same set value, at the step 3. In such operating condition of the engine as this, no leaning of the mixture being supplied to the main chambers 2 is effected by the use of either of the coefficients KLS, KIDL, and accordingly there is no need of increasing the quantity of fuel being supplied to the sub chambers.

If the system of FIG. 1 is adapted to effect feedback control responsive to the output from the $O_2$ sensor 18 in FIG. 1 in such a manner that at the same time the main throttle valve 16 is opened to a predetermined valve opening degree from a substantially fully closed position, the feeback control of the air-fuel ratio to a desired value is initiated, and if the method of the present invention is applied to such adapted system in this feedback mode, excellent control responsivenes can be achieved that the feedback control of the air-fuel ratio can be initiated immediately upon opening of the main throttle valve 6 to the predetermined valve opening degree when the engine is operating in the idling region, because according to the method of the invention, the basic fuel quantity values to be applied in the idling region are set at such values as to achieve a predetermined air-fuel ratio at which the three-way catalyst 16 can exhibit the best or optimum conversion efficiency as previously noted.

Moreover, if the system of FIG. 1 is adapted to act to increase the quantity of fuel being supplied to the engine upon turning-on of any one of auxiliary equipments such as the air conditioner, not shown, and if the method of the invention is applied to such adapted system, the control for such fuel quantity increase can be simplified, because according to the invention the basic fuel quantity values applied in the idling region and ones applied in the other operating regions of the engine can be set at such values as to achieve the same desired value. As a specific example of control for obtaining such fuel quantity increase responsive to turning-on of an auxiliary equipment, the value of the coefficient K1 in the aforementioned equation (1) may be set as the product of various correction coefficients, one of which is used as a correction coefficient responsive in value to turning-on and -off of a certain auxiliary equipment, thereby enabling to supply suitably increased quantities of fuel to the engine upon turning-on of the auxiliary equipment in the idling region as well as in any of the other operating regions of the engine, and making it unnecessary to employ different kinds of correction values for this purpose according to the operating regions of the engine applied.

What is claimed is:

1. A fuel supply control method for an internal combustion engine having an intake passage and an exhaust passage, a throttle valve arranged in said intake passage, and exhaust gas purifying means arranged in said exhaust passage, the method being adapted to store a plurality of predetermined basic fuel quantity values which correspond, respectively, to a plurality of predetermined values of at least one operating parameter of said engine indicative of intake air flow rate, other than throttle valve opening, and the rotational speed of the engine, read out one of said predetermined basic fuel quantity values which corresponds to the detected value of said at least one operating parameter, determine from said read one basic fuel quantity value a quantity of fuel appropriate to an operating condition in which said engine is operating, and supply the determined quantity of fuel to said engine, the method comprising the steps of:

(a) setting at least part of said basic fuel quantity values which correspond to ones of said predetermined values of said at least one operating parameter that are to be assumed when said engine is operating in an idling region, at such predetermined values as to obtain an air-fuel mixture having a predetermined air-fuel ratio at which said exhaust gas purifying means can exhibit an optimum conversion efficiency thereof;

(b) detecting the valve opening of said throttle valve, determining whether or not the detected valve opening of said throttle valve is equal to or smaller than a predetermined value corresponding to a substantially fully closed position of said throttle valve, and determining that said engine is operating in said idling region when the detected valve opening of said throttle valve is equal to or smaller than said predetermined value; and (c) decreasing by a predetermined correction value each of said at least part of said basic fuel quantity values set to said predetermined values, which is read out, when it is determined that said engine is operating in said idling region.

2. A fuel supply control method as claimed in claim 1, including the step of setting ones of said basic fuel quantity values other than said at least part thereof, which correspond to ones of said predetermined values of said at least one operating parameter that are to be assumed when said engine is operating in regions other than said idling region, at predetermined values as to achieve the same air-fuel ratio as said predetermined air-fuel ratio.

3. A fuel supply control method as claimed in claim 1, wherein said predetermined correction value is set to such values as to make the air-fuel ratio of said air-fuel mixture smaller as the rotational speed of said engine decreases.

4. A fuel supply control method as claimed in claim 1, wherein said exhaust gas purifying means comprises a three-way catalyst, said predetermined air-fuel ratio being equal to a theoretical mixture ratio.

5. A fuel supply control method as claimed in claim 1, wherein said determination of said step (b) that said engine is operating in said idling region is established on condition that the temperature of said engine is higher than a predetermined value.

6. A fuel supply control method as claimed in claim 1, wherein said determination of said step (b) is established on condition that leaning of said air-fuel mixture is then not being effected, which is to be effected when said engine is operating in a predetermined low load region.

7. A fuel supply control method for an internal combustion engine having at least one main combustion chamber, a sub combustion chamber communicating with a corresponding one of said at least one main combustion chamber, an exhaust passage, and exhaust gas purifying means arranged in said exhaust passage, the method being adapted to store two groups of predetermined basic fuel quantity values to be supplied, respectively, to said at least one main combustion chamber and said sub combustion chamber, said predetermined basic fuel quantity values in each of said two groups corresponding, respectively, to a plurality of predetermined values of at least one operating parameter of said engine, detect a value of said at least one operating parameter, read out one of said predetermined basic fuel quantity values from each of said two groups which corresponds to the detected value of said at least one operating parameter, determine from said read one basic fuel quantity value a quantity of fuel appropriate to an operating condition in which said engine is operating, and supply the determined quantity of fuel to each corresponding one of said at least one main combustion chamber and said at least one sub combustion chamber, the method comprising the steps of: (a) setting at least part of said basic fuel quantity values of each of said two groups, which correspond to ones of said predetermined values of said at least one operating parameter that are to be assumed when said engine is operating in an idling region, at such predetermined values as to obtain an air-fuel mixture having a predetermined air-fuel ratio at which said exhaust gas purifying means can exhibit a maximum conversion efficiency thereof; (b) determining whether or not said engine is operating in said idling region; and (c) decreasing by a first predetermined correction value each of said at least part of said basic fuel quantity values set to said predetermined values of one of said two groups to be supplied to said at least one main chamber, which is read out, and increasing by a second predetermined correction value each of said at least part of said basic fuel quantity values set to said predetermined values of the other of said two groups to be supplied to said sub chamber, which is read out, when it is determined that said engine is operating in said idling region.

8. A fuel supply control method for an internal combustion engine having an intake passage and an exhaust passage, a throttle valve arranged in said intake passage, and exhaust gas purifying means arranged in said exhaust passage, the method being adapted to store a plurality of predetermined basic fuel quantity values which correspond, respectively, to a plurality of predetermined values of at least one operating parameter of said engine, detect a value of said at least one operating parameter, read out one of said predetermined basic fuel quantity values which corresponds to the detected value of said at least one operating parameter, determine from said read one basic fuel quantity value a quantity of fuel appropriate to an operating condition in which said engine is operating, and supply the determined quantity of fuel to said engine, the method comprising the steps of:

(a) setting at least part of said basic fuel quantity values which correspond to ones of said predetermined values of said at least one operating parameter that are to be assumed when said engine is operating in an idling region, at such predetermined values as to obtain an air-fuel mixture having a predetermined air-fuel ratio at which said exhaust gas purifying means can exhibit an optimum conversion efficiency thereof;

(b) detecting the value opening of said throttle valve, determining whether or not the detected valve opening of said throttle valve is equal to or smaller than a predetermined value corresponding to a substantially fully closed position of said throttle valve, and determining that said engine is operating in said idling region when the detected valve opening of said throttle valve is equal to or smaller than said predetermined value;

(c) determining whether or not leaning of said air-fuel mixture is being effected while the engine is operating in a predetermined low load region; and (d) when it is determined that leaning of said air-fuel mixture is being effected while the engine is operating in a predetermined low load region, decreasing by a predetermined correction value each of said at least part of said basic fuel quantity values set to said predetermined values, which is read out, when it is determined that said engine is operating in said idling region.

9. A fuel supply control method for an internal combustion engine having an intake passage and an exhaust passage, a throttle valve arranged in said intake passage, and exhaust gas purifying means arranged in said exhaust passage, the method being adapted to store a plurality of predetermined basic fuel quantity values which correspond, respectively, to a plurality of predetermined values of at least one operating parameter of said engine, detect a value of said at least one operating parameter, read out one of said predetermined basic fuel quantity values which corresponds to the detected value of said at least one operating parameter, determine from said read one basic fuel quantity value a quantity of fuel appropriate to an operating condition in which said engine is operating, and supply the determined quantity of fuel to said engine, the method comprising the steps of:

(a) setting at least part of said basic fuel quantity values which correspond to ones of said predetermined values of said at least one operating parameter that are to be assumed when said engine is operating in an idling region, at such predetermined values as to obtain an air-fuel mixture having a predetermined air-fuel ratio at which said exhaust gas purifying means can exhibit an optimum conversion efficiency thereof;

(b) determining whether or not said engine is operating in said idling region; and (c) decreasing by a predetermined correction value which is determined in accordance with detected rotational speed of the engine each of said at least part of said basic fuel quantity values set to said predetermined values, which is read out, when it is determined that said engine is operating in said idling region, said predetermined correction value being set to such values as to make the air-fuel ratio of said air-fuel mixture smaller as said detected rotational speed of the engine decreases.

* * * * *